US011946709B2

(12) United States Patent
Mortsch et al.

(10) Patent No.: US 11,946,709 B2
(45) Date of Patent: Apr. 2, 2024

(54) FIREARM INCLUDING AN EXTRACTOR ASSEMBLY

(71) Applicant: GLOCK TECHNOLOGY GMBH, Ferlach (AT)

(72) Inventors: Martin Mortsch, Techelsberg (AT); Philipp Kogler, St. Margareten (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 30 days.

(21) Appl. No.: 17/905,612

(22) PCT Filed: Jan. 14, 2021

(86) PCT No.: PCT/EP2021/050688
§ 371 (c)(1),
(2) Date: Sep. 2, 2022

(87) PCT Pub. No.: WO2021/175503
PCT Pub. Date: Sep. 10, 2021

(65) Prior Publication Data

US 2023/0160651 A1 May 25, 2023

(30) Foreign Application Priority Data

Mar. 4, 2020 (EP) ..... 20160908

(51) Int. Cl.
*F41A 15/14* (2006.01)

(52) U.S. Cl.
CPC ..... *F41A 15/14* (2013.01)

(58) Field of Classification Search
CPC ..... F41A 15/00; F41A 15/08; F41A 15/10; F41A 15/12; F41A 15/16; F41A 15/18; F41A 15/14
USPC ..... 42/14, 25
See application file for complete search history.

(56) References Cited

U.S. PATENT DOCUMENTS 1,377,629 A * 5/1921 Rosebush ..... F41A 15/14 89/196
4,021,955 A * 5/1977 Curtis ..... F41A 17/72 42/70.08
5,794,373 A * 8/1998 Moon ..... F41A 15/12 42/25
8,887,427 B2 * 11/2014 Zukowski ..... F41A 15/00 42/25
9,062,926 B2 * 6/2015 Lee ..... F41A 15/10
9,784,514 B1 * 10/2017 Carr ..... F41A 15/14
(Continued)

FOREIGN PATENT DOCUMENTS

EP 2860484 A1 4/2015

*Primary Examiner* — John Cooper
(74) *Attorney, Agent, or Firm* — Raven Patents, LLC; Anton E. Skaugset

(57) ABSTRACT

Firearms including a slide, an ejector and an extractor assembly, which extractor assembly includes at least one stirrup-shaped extractor, a plunger and a biasing element. Production of such firearms is easier, and their assembly and/or disassembly is simpler, where the plunger includes a plunger body and a plunger extension, a frame is provided for mounting the biasing element and at least the plunger body, the slide includes a receiving groove for the frame, and the slide includes a maintenance bore which, in the installed state, penetrates the slide from below in the direction of the receiving groove and is provided in the region of the plunger body.

11 Claims, 7 Drawing Sheets

(56) References Cited

U.S. PATENT DOCUMENTS

| | | | | |
|---|---|---|---|---|
| 11,067,348 | B1 * | 7/2021 | Ribic | F41A 3/66 |
| 2004/0159032 | A1 | 8/2004 | Szabo | |
| 2009/0071053 | A1 * | 3/2009 | Thomele | F41A 11/02 42/70.08 |
| 2011/0252686 | A1 | 10/2011 | Coleman | |

* cited by examiner

FIREARM INCLUDING AN EXTRACTOR ASSEMBLY

TECHNICAL FIELD

The disclosure is directed generally to firearms, and more particularly to firearms having an improved extractor assembly that is less subject to accidental disassembly and that creates an outer contour of the firearm that is as closed as possible.

BACKGROUND

The firearms of the present disclosure are explained with reference to a blowback system for pistols; a person skilled in the art can, in knowledge of the present disclosure and the following examples, easily transfer this system to other form-fit or force-fit locking systems for firearms, such as rotating bolts.

In general, it can be stated for the operation of firearms that after a cartridge has been fired, the empty cartridge case must be removed from the cartridge chamber of a firearm as reliably as possible before a new cartridge can be supplied during the reloading process. Similarly, reliable removal of an unfired cartridge from the cartridge chamber may be required for unloading or repeating processes, which are carried out e.g. during training with the weapon.

In this case, an extractor is brought into engagement with the cartridge case, usually during the loading and locking process. When the breech is opened, there is often a backward movement and/or a tilting movement of the breechblock, as a result of which the cartridge case is pulled out of the cartridge chamber. This relative movement is completed with the process of expelling the cartridge or case, in which an ejector forces the cartridge case away to one side or flings it out of the firearm by striking the cartridge case, usually when an expulsion opening is reached. The ejector can be fixed to the receiver, for example in the grip (also known as the pistol frame), or it can also be moved when a shot is fired, if it is arranged e.g. in the slide, or in a movable bolt head. These processes have been known to a person skilled in the art for a long time and therefore do not require further explanation at this point.

In most cases, extractors have a talon or claw shape on the cartridge-facing side in order to ensure good contact with a groove or the edge of the cartridge.

Very often, an extractor assembly is designed similarly to a rocker in terms of shape and function and is movably mounted in the receiver or the slide by means of a bearing pin or peg. A spring applies a force to one lever arm of the extractor, thus pre-loading the second lever arm toward the inside of the weapon. U.S. Pat. No. 8,887,427 B2 should be mentioned at this point merely as an example of such a rocker design.

However, extractor assemblies of this kind require a certain amount of installation space, as otherwise too little leverage on the extractor can lead to impaired functioning. In addition, the bearing pin is designed, relative to the surrounding components, as a relatively delicate component which is difficult or even impossible to dismantle under operating conditions, which makes it considerably harder to clean and maintain the extractor assembly.

In the case of firearms, in particular pistols, a further concept has become widespread with the introduction of GLOCK pistols in the 1980s. Here, the extractor is stirrup-shaped, or substantially U-shaped, and is pre-loaded in the slide toward the central plane of the weapon by means of a spring-loaded depressor plunger. The stirrup-shaped extractor comprises a first bearing lever which can be slightly wider than the connection segment to the second lever, the extractor lever. The bearing lever is often substantially cask-shaped and is used for mounting in a bearing opening of the slide which extends outward radially with respect to the barrel bore axis and is no longer visible from the outside due to the insertion of the extractor. This bearing opening allows a stable fit of the extractor and limited movement of the extractor about a tilting axis, which is normal and laterally offset with respect to the barrel bore axis. The second extractor lever is used for temporary contact with a cartridge case and is deflected slightly "outward" over the edge of the cartridge base during the locking process, in order to engage with said base or a groove provided for this purpose.

U.S. Pat. No. 9,062,926 B2, U.S. Pat. No. 5,794,373 A, US 2011/252686 A1 or U.S. Pat. No. 9,784,514 B1 are cited as examples of such extractor assemblies and developments thereof. The contents of these documents and those of U.S. Pat. No. 8,887,427 B2, the U.S. Pat. No. 1,377,629 A and US 2004/0159032 A1 as well as the EP 2 860 484 A1, which is dealt with further down, are incorporated by reference into the contents of the disclosure of this application for all purposes in those the jurisdictions where this is possible.

In the documents mentioned, the bearing lever is usually cask-shaped and is pushed from "behind" in the direction of the central weapon plane, or the barrel bore axis, by means of the spring-loaded depressor plunger in the installed state. In addition, there may be a step at the rear, at the "back" as viewed in the installation situation, which step prevents the extractor from falling out due to the depressor plunger. This concept provides high mechanical stability and has proven to be very reliable.

It is also clear from the above-mentioned documents that the depressor plunger assembly, comprising an elongated cylindrical depressor plunger and at least one depressor plunger spring, that is arranged in a borehole inside the slide. On the rear side, another spring bearing can be provided between the depressor plunger spring and the slide cover plate. The borehole for receiving the depressor plunger assembly is preferably at a slightly oblique angle with respect to the barrel bore axis, as is clear, inter alia, from US 2011252686 A1.

In order to produce such an oblique borehole relative to the centrally extending firing pin receiving borehole, however, greater manufacturing outlay is required than would be the case with a parallel borehole, for example. This naturally requires more set-up effort and time, which in turn results in higher production costs.

Moreover, in the case of stirrup-shaped extractors, depressor plunger assemblies known to date are to be introduced "from behind" into the slide and are usually locked in the slide by means of a cover plate and the depressor plunger spring is thus tensioned. The disassembly and/or assembly of these depressor plungers to be tensioned from "behind" requires some degree of practice and is usually not intended for regular cleaning of the weapon, but instead should be carried out by a person skilled in the art or by specially trained personnel. This is all the more applicable in order to avoid scratching the surface of the weapon during disassembly/assembly with a tool and to prevent possible optical defects and/or corrosion.

For the most part only extractor assemblies in which the depressor plunger is visible from the outside are known to date. Owing to the construction, a small gap is often formed between the slide and the extractor. Said gap is generally not protected against the ingress of dust or foreign bodies, and a closed surface, or a concealed functional assembly, such as that of the extractor assembly, is more aesthetically pleasing to most users than an arrangement of, e.g., corners and edges or even recesses. In addition, plastics materials are increasingly used for individual components of a firearm, such as for forming the slide cover plate on the rear side. It is therefore desirable to avoid, as far as possible, scratching these components by disassembly/assembly of the slide and/or the extractor assembly during maintenance and cleaning work.

Moreover, small dimensions of the extractor assembly with the simplest possible disassembly/assembly are desired.

SUMMARY

The present disclosure concerns firearms that include an extractor assembly which is as compact and stable as possible and is also as easy to manufacture as possible. The present disclosure further provides an extractor assembly which is as well-protected as possible against accidental disassembly and also has an outer contour of the weapon which is as closed as possible.

In one example, the disclosure provides firearms that include a slide, an ejector, and an extractor assembly, where the extractor assembly includes at least one stirrup-shaped extractor, a frame, a plunger, and a biasing element; the plunger includes a plunger body and a plunger extension; and the plunger body and the biasing element are mounted in the frame. The slide includes a receiving groove configured to receive the frame, and a maintenance bore in a region of the plunger body, such that when the slide is in an installed state, the maintenance bore penetrates the slide from below in the direction of the receiving groove.

BRIEF DESCRIPTION OF THE DRAWINGS

FIG. 7A depicts the insertion of a tool. FIG. 7B depicts the release of the extractor, and FIG. 7C depicts the extractor removed.

DETAILED DESCRIPTION

Figure 1:
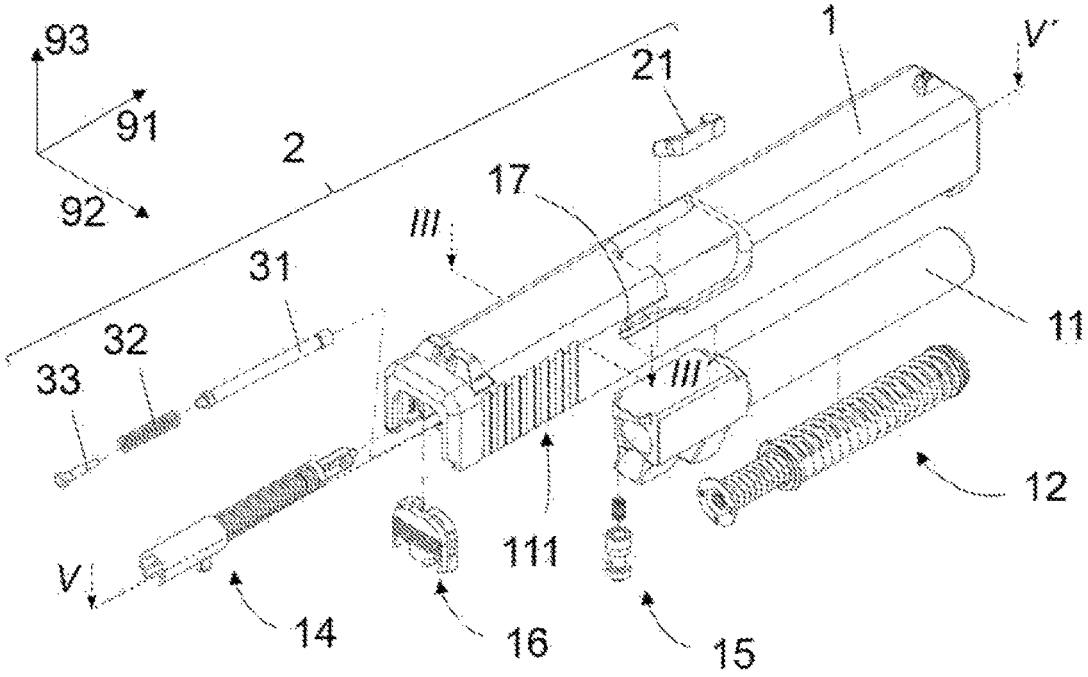
FIG. 1 is a simplified exploded view of a slide according to the prior art.

The terms left, right, above, below, front and back/behind always refer in the following to the view of the shooter in the firing direction of the firearm when it is held ready to fire. The weapon has, extending through the barrel axis and oriented vertically, a central plane of the weapon which, cum grano salis, forms a plane of symmetry.

Although described in the context of a pistol, the extractor assemblies of the present disclosure may also be useful in conjunction with a variety of small arms, including handguns and long guns such as rifles and carbines, without limitation.

In order to achieve the desirable characteristics discussed above, a firearm according to the present disclosure includes a slide, an ejector and an extractor assembly; the extractor assembly comprises a stirrup-shaped extractor, a plunger and a biasing element. The extractor is stirrup-shaped, similar to that in the documents mentioned above, and has a first bearing lever, facing the plunger in the installed state, for mounting in the slide, and a second extractor lever provided for temporary contact with a cartridge case. According to the present disclosure, the plunger comprises a plunger body and a plunger extension, the plunger body being provided for reception and mounting together with the biasing element in a frame. The slide of the firearm further comprises a receiving groove for the frame, and a maintenance bore in the region of the plunger body, which bore penetrates the slide in the direction of the receiving groove in the installed state.

By forming a frame, the biasing element and the plunger body can advantageously be assembled outside the weapon, thus achieving a pre-loaded state of the plunger. The use of a frame also makes it possible to use a biasing element, preferably a spiral spring, with very high spring force. This in turn allows relatively small dimensions of the extractor assembly, while relatively simple assembly, or, in reverse order, disassembly, is still possible.

Furthermore, the design according to the present disclosure of the extractor assembly makes it possible to avoid the cost-intensive and time-intensive production of an oblique borehole within the slide. In principle, it would be sufficient to provide a receiving groove in the slide, which receiving groove has a substantially complementary shape to the external dimensions, such that the frame can be easily inserted from the front. Specific modifications may also be provided according to the description of the drawings.

In order to assemble the extractor assembly, after the frame is inserted into the receiving groove, only the plunger body is slightly deflected backward by a tool being inserted through a maintenance bore provided therefor in the slide, preferably from below. The tip of the tool has the effect that the plunger extension, which is deflected forward in a spring-loaded manner on the plunger body in the installation situation, is pushed backward. The extractor can then be inserted from the outside in a known manner and the blocking effect of the plunger extension on the extractor can be restored by removing the tool. Both the extractor and the frame are therefore secured in the slide against slipping and/or falling out.

In addition, the extractor assembly is therefore very well concealed inside the handgun and preferably only one side of the frame is substantially flush with the surface of the slide. This can achieve the most continuous surface possible in this region, without additional openings, edges or protrusions. This promotes, inter alia, the reduction of deposits in the openings, which can be caused by soil, dust, dirt, etc.

In particular, stirrup-shaped extractors, as in the disclosed embodiment according to the present disclosure, can perform an additional function by temporary interaction with the firing pin safety. In handguns, preferably in pistols, a firing pin safety can be arranged at the front end of the firing pin, as is described very clearly in, inter alia, EP 2 860 484 A1. The contents of this document are incorporated by reference into the contents of the disclosure of this application for jurisdictions where this is possible.

Such a firing pin safety is operatively connected to the trigger bar and, when the trigger bar is operated, is moved such that the path of the firing pin is cleared. The firing pin safety is, like the extractor, mounted in the slide so as to be spring-loaded and has roughly the shape of a cylinder which has two opposing lateral recesses transversely to the longitudinal axis. One of these recesses, facing the central plane of the weapon, allows the firing pin to move in the release position, while the second recess, facing outward, is used for temporary contact with the extractor, which, due to this design, prevents the firing pin safety from falling out when the firing pin is pulled backward.

Other components of a firearm, in particular of a pistol, such as the grip, various safety devices or the firing mechanism are not described in more detail in the context of this description, as a person skilled in the art, having knowledge of the present disclosure, can make any desired modifications easily and without difficulty based on his or her knowledge in the art.

FIG. 1 is an exploded illustration, by way of example, of the previously best-known and most widely used extractor assembly 2 for GLOCK pistols. The schematic illustration comprises a slide 1, in which a barrel 11 and a recoil spring assembly 12 can be received at the bottom. A firing pin safety 15 with spring can be introduced from below into a clearance provided therefor in the slide 1 and can, in the manner described above, be secured against falling out by the extractor 21. It can be very clearly seen in FIG. 1 that the firing pin assembly 14, just like a depressor plunger assembly 3 (FIG. 3) consisting of a depressor plunger 31, a depressor plunger spring 32, and a spring bearing 33, can be inserted from behind into the slide 1 and secured by means of the slide cover plate 16. The installed state can be seen by viewing FIG. 1 in combination with FIG. 3, which also shows the borehole for the depressor plunger assembly 3, which borehole is formed obliquely with respect to the central plane of the weapon. In FIG. 1, several serrations 111 can be seen in the rear region of the slide 1.

Figure 2:
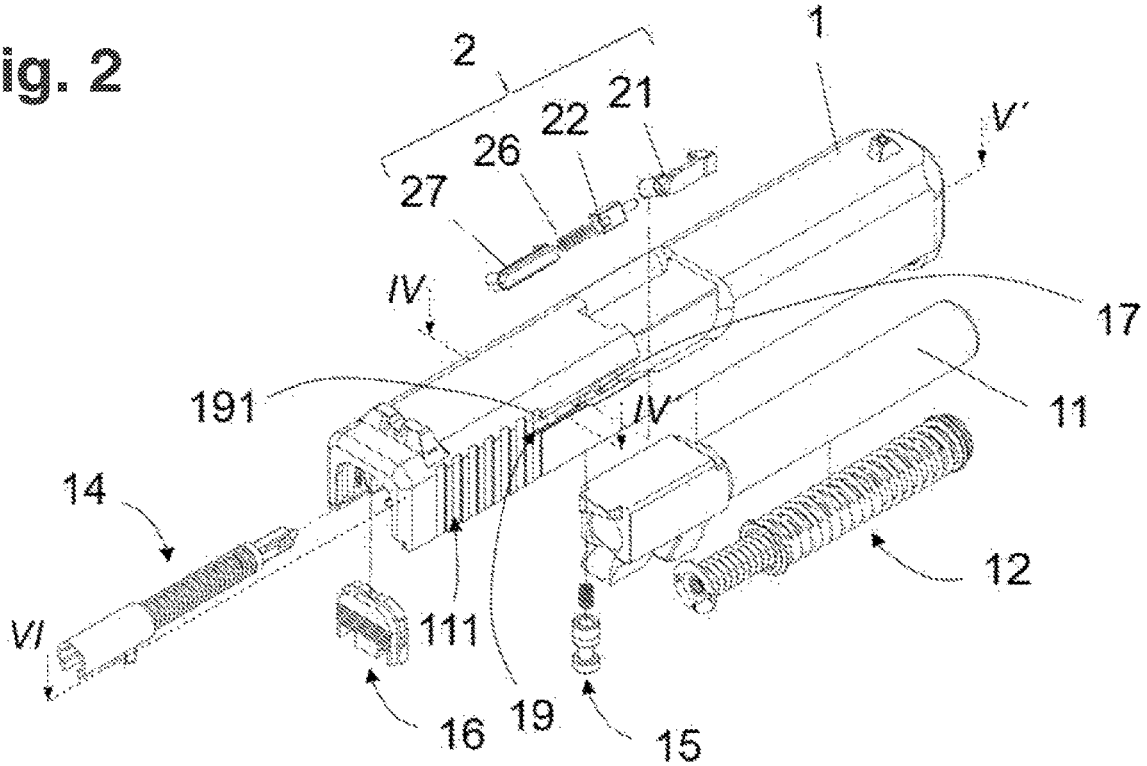
PRIOR ART Fig. 2
FIG. 2 is a simplified exploded view of a slide having an illustrative extractor assembly according to an embodiment of the present disclosure.

FIG. 2 is a schematic exploded view of a similar slide 1 of a pistol, analogously to FIG. 1, but with an extractor assembly 2 designed according to the present disclosure. It can be directly seen that the extractor assembly 2 consists only of a frame 27, a biasing element 26 and a plunger 22, which can all now be inserted from the "front" into the slide 1 in order to interact with the extractor 21. Advantageously, the use of the frame 27 and the mounting of the plunger 22 and the biasing element 26 in the frame 27 makes it possible to assemble the plunger 22, and subsequently to pre-load the plunger 22 in the direction of the bearing lever 212, outside the slide 1, which makes it considerably easier to assemble this extractor assembly 2.

Figure 3:
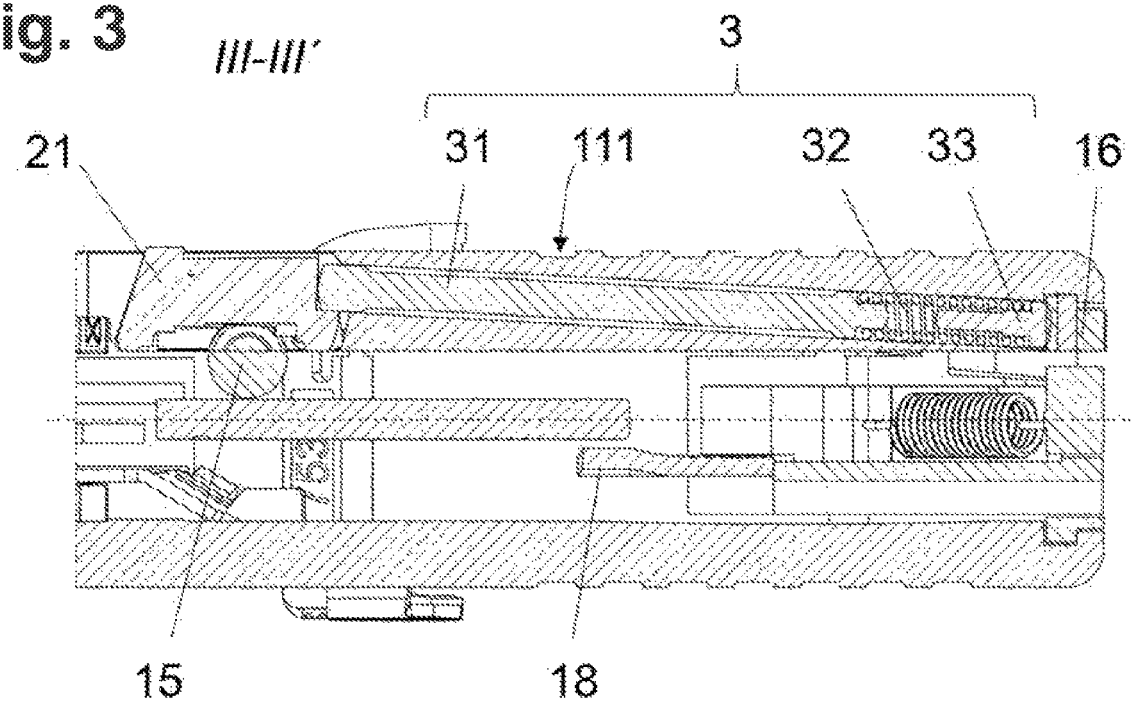
FIG. 3 is a horizontal sectional view of the slide of FIG. 1 in the region III-III'.
Figure 4:
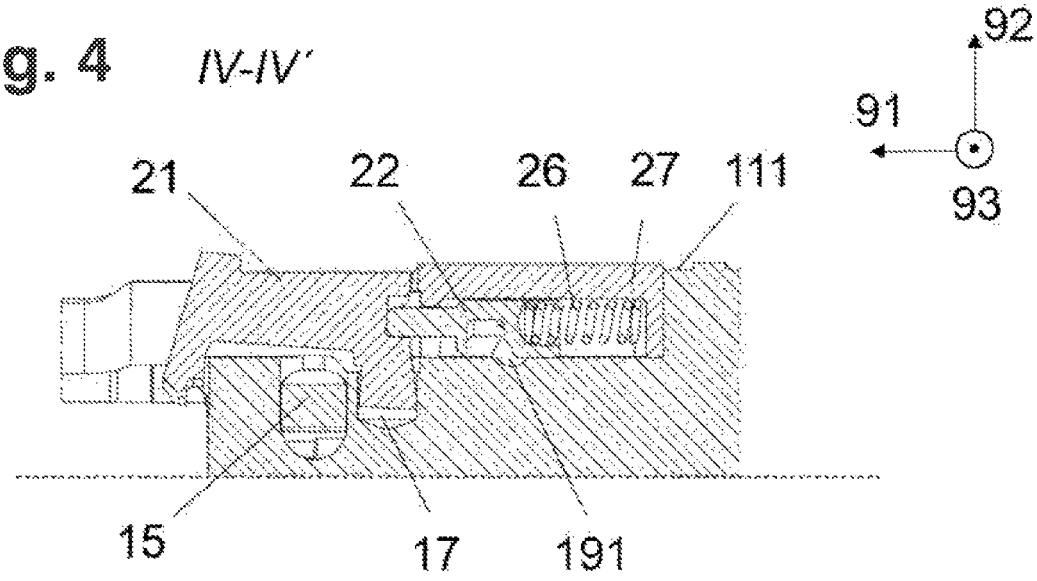
FIG. 4 is a horizontal sectional view of the slide of FIG. 2 in the region IV-IV'.

FIGS. 3 and 4 are each a section through a weapon along a horizontal plane in the installation situation, as seen in a viewing direction in the vertical direction 93 from "above," in the regions III-III' in FIG. 1 and the regions IV-IV' in FIG. 2, respectively. The appearance of the extractor 21 in FIGS. 3 and 4 is slightly different due to the different section planes, as a result of which the firing pin safety 15 also looks different.

In the section in FIG. 3, the depressor plunger assembly 3 known from the prior art and its effect on the extractor 21 can clearly be seen. The extractor 21 is seated via its bearing lever 212 (FIG. 9) in the bearing opening 17, as can also be seen in the variant according to the present disclosure in FIG. 4, pre-loaded by the depressor plunger 31 in the direction of the central plane of the weapon. This process is carried out analogously in FIG. 4 by the effect of the plunger 22 on the bearing lever 212. In both cases, it can clearly be seen that the depressor plunger 31 and the plunger extension 222 (FIG. 6) of the plunger 22 engage in a small shoulder of the extractor 21 and allow a loss-proof arrangement. It is very clearly visible from the comparison of the two types of construction that the biasing element 26 and the plunger 22 are mounted in the frame 27 and are relatively well protected "outward" in the normal direction 92, while the depressor plunger 31, the depressor plunger spring 32 and the spring bearing 33 must be introduced from "behind" and tensioned during assembly by the insertion of the slide cover plate 16.

For the sake of completeness, it should be noted that, although not shown separately in FIG. 4, it is also possible to arrange the ejector 18 so as to be fixed to the receiver, as can be seen in FIG. 3. The ejector 18 in FIG. 3 is fixed in a grip (not shown) and interacts with the cartridge case head in the manner described above, which is familiar to a person skilled in the art.

Figure 5:
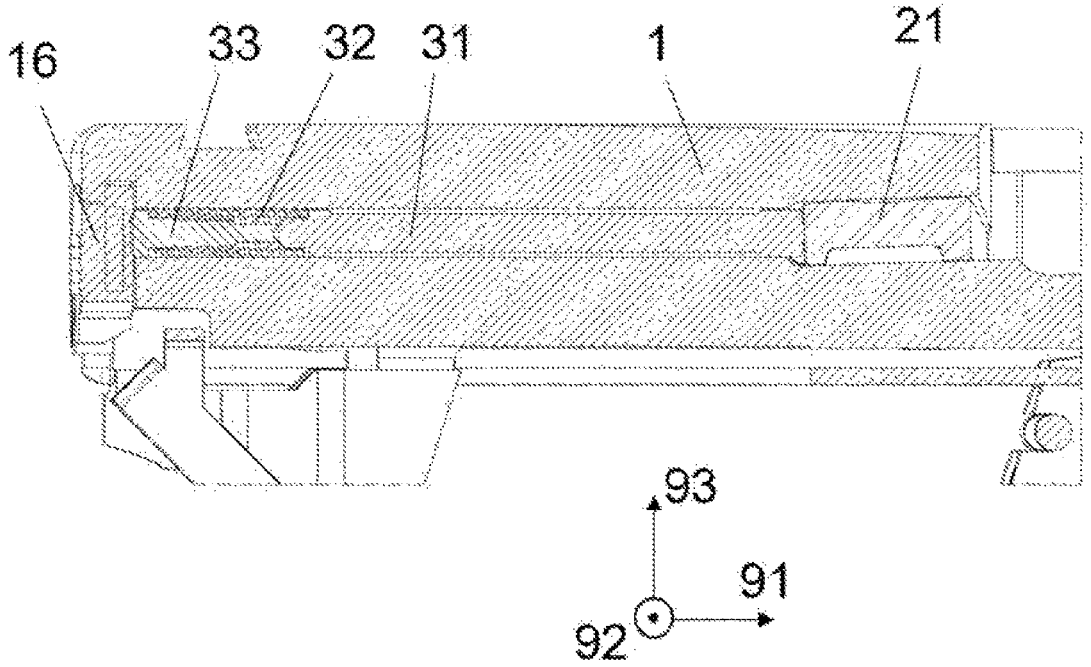
FIG. 5 is a vertical sectional view of the slide of FIG. 1 from the right side and in the installed state.
Figure 6:
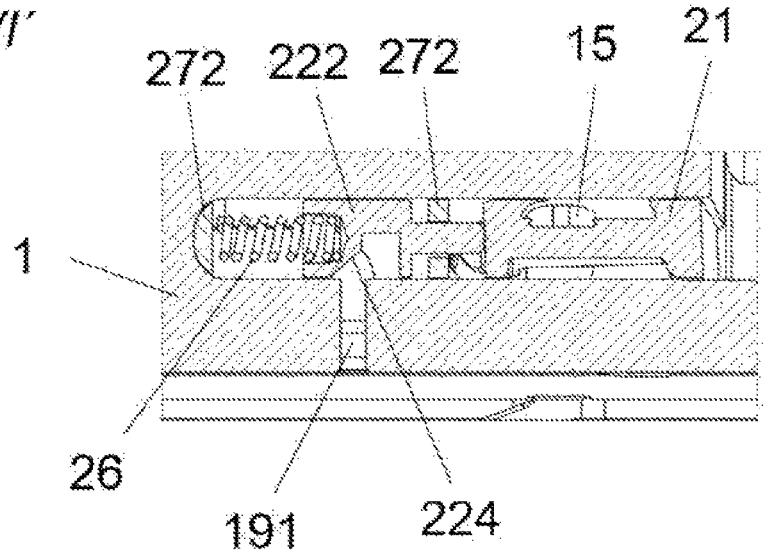
FIG. 6 is a vertical sectional view of the slide of FIG. 2 from the right side and in the installed state.

Analogously thereto, FIGS. 5 and 6 are cross sections through the weapon in the vertical direction 93 in the installed state, the viewing direction shown being from the "right" in the normal direction 92. Analogously to FIGS. 3 and 4, the different extractor assembly 2 can also be very clearly seen in these illustrations.

Figure 7A:
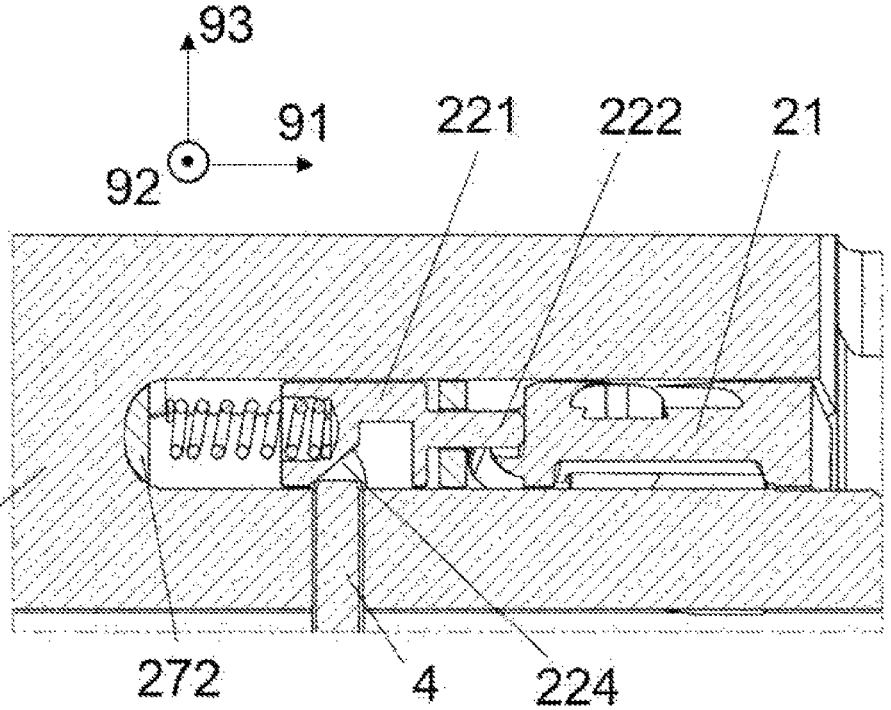
FIGS. 7A-7C schematically illustrate an illustrative disassembly process for a firearm having an extractor assembly of the present disclosure.
Figure 7B:
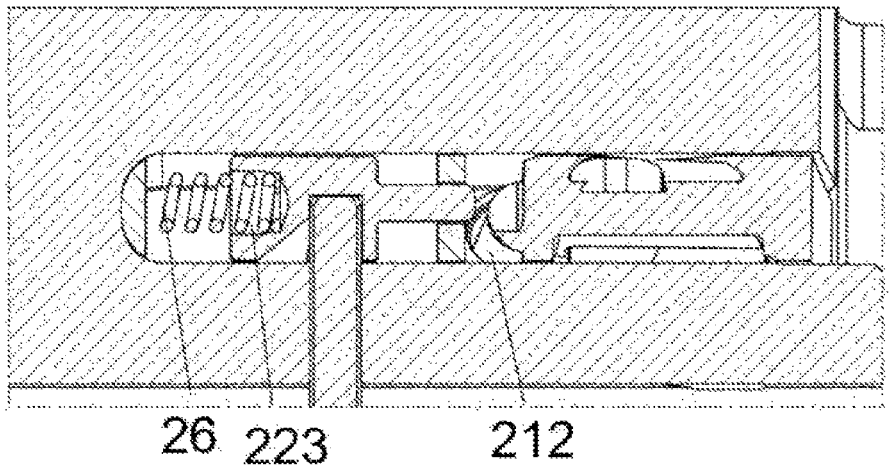
Figure 7C:
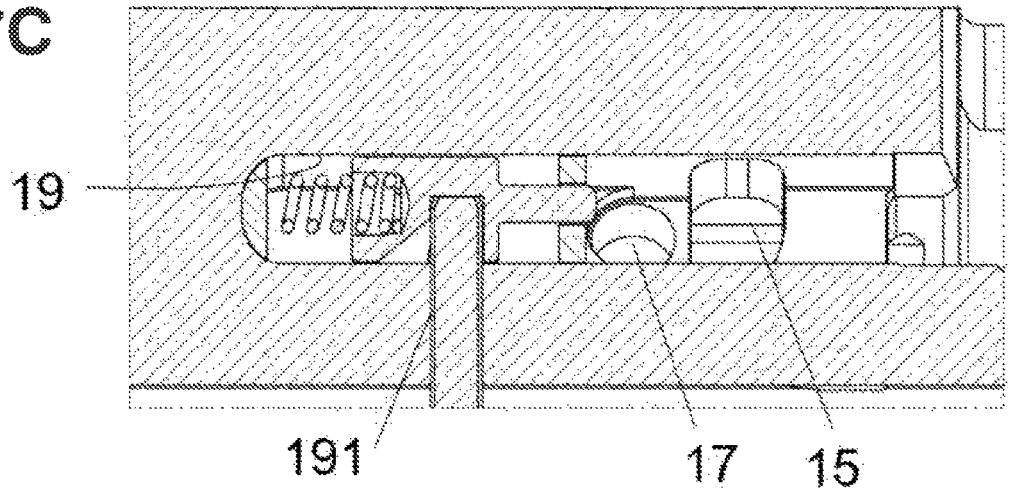

The effect of the extractor assembly 2 according to the present disclosure and the disassembly/assembly thereof are explained by way of example with reference to FIGS. 4, 6, and 7. A maintenance bore 191 is provided in the slide 1, which bore passes through the slide 1 substantially from "below" in the vertical direction 93. The maintenance bore is provided in the region of the plunger body 221 such that a tool 4, or another narrow makeshift object, can be inserted when the weapon is partially dismantled in order to interact with the plunger body 221 such that the plunger extension 222 is moved "backward." In the present example, in FIG. 7A the tip of the tool touches a chamfer 224 of the plunger body 221, as a result of which the extractor 21 is displaced and finally released (see FIG. 7B) and can be removed from the weapon (cf. FIG. 7C). Subsequently, the tool can be removed and, if necessary, the frame 27 can be moved forward in the longitudinal direction of the weapon, in order to be removed from the slide.

In order to ensure a good fit of the frame 27 in the slide 1 and to prevent an "outward" movement of the frame 27, it has proven advantageous for the receiving groove 19 (see also FIG. 2) to be adapted to the cross-sectional shape of the frame 27, i.e. to have a substantially complementary shape thereto. The shape-complementary design of the receiving groove 19 and the frame 27 can be e.g. wedge-shaped, or formed by one or more shoulders, in order to ensure suitable support of the frame 27 in the slide 1.

It is particularly advantageous for at least one additional guide 271 to be formed on the frame 27, which guide interacts with the shape-complementary receiving groove 19. Such a guide 271 on the frame 27 can also be one- or double-sided and/or wedge-shaped, as would be the case e.g.

with a dovetail profile. A "T-shaped" design of the cross section of the frame 27 or the receiving groove 19 is also conceivable. The design of guides 271 facilitates insertion during assembly of the frame 27 and provides an extremely stable fit with low surface pressure of the contact surfaces between the slide 1 and the frame 27.

FIG. 8 schematically shows several variants of frames 27, with such double-sided guides 271 being clearly visible. In addition to providing loss prevention for the frame 27, such guides 271 can also provide improved sealing of the slide 1 "outward" and reduce the ingress of dirt, water and the like into the extractor assembly.

Figure 8A:
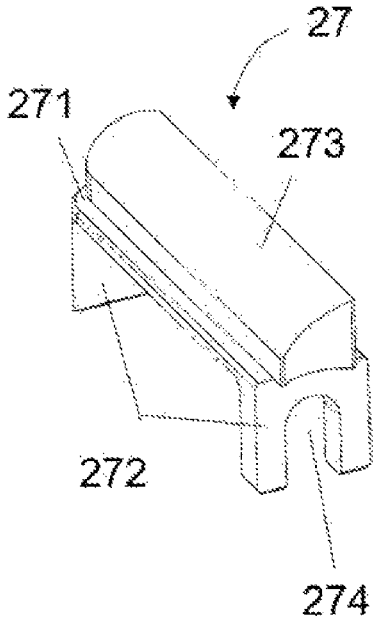
FIGS. 8A-8C depict selected illustrative embodiments of frames according to the present disclosure.
Figure 8B:
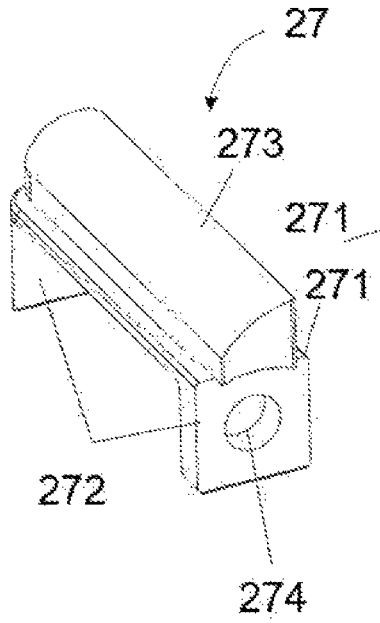
Figure 8C:
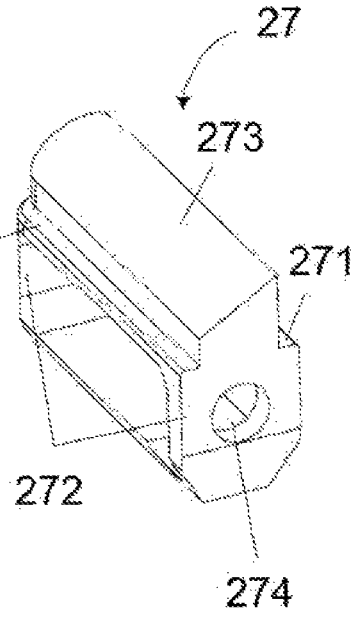

In the embodiments in FIG. 8, various frames 27 can be seen which have at least one first and second side element 272 and are held together by means of a connection piece 273 or a connection segment. The connection piece 273 can preferably have a contour that deviates as little as possible from the weapon contour in the installation situation. The first side element 272 nearer the plunger 22 comprises an opening 274 for a plunger extension 222. This opening 274 preferably extends continuously "inward" or "downward," viewed in the installed state (see FIG. 8A); however, it can also be designed simply as a hole (see FIGS. 8B and 8C). By suitable choice of this opening 274, in coordination with the plunger 22 and the biasing element 26, a highly space-saving and easy-to-assemble design of the frame 27 can be achieved.

In other words, with a slot-like opening 274 it is not necessary to press the plunger body 221 backward against the spring force until the plunger extension 222 can be moved past the front side element 272 and pass through the opening 274, but rather the plunger extension 222 can be inserted from "below." This can be advantageous especially for very rigid biasing elements 26.

FIG. 8C shows a further possible modification, according to which the frame 27 is closed on the inside of the weapon in the installed state. This feature can be selected, if required, in order to achieve immense stability of the frame 27 by supporting the side elements 272 on both sides.

Figure 9A:
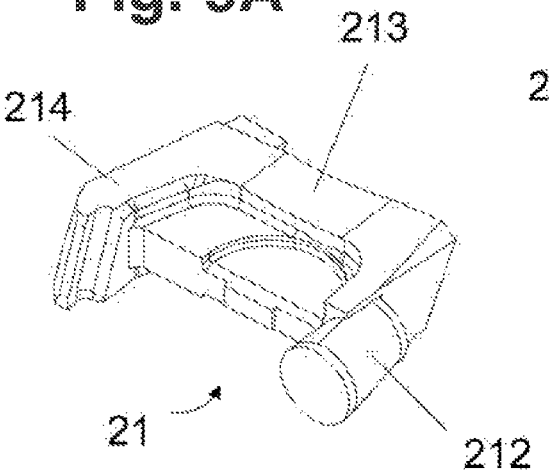
FIG. 9A depicts the geometry of an extractor according to the prior art.
Figure 9B:
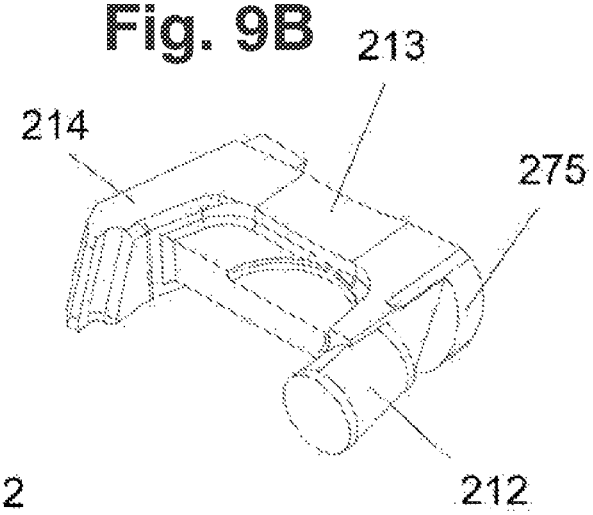
PRIOR ART Fig. 9B
FIG. 9B depicts an illustrative extractor according an embodiment of the present disclosure.
Figure 10A:
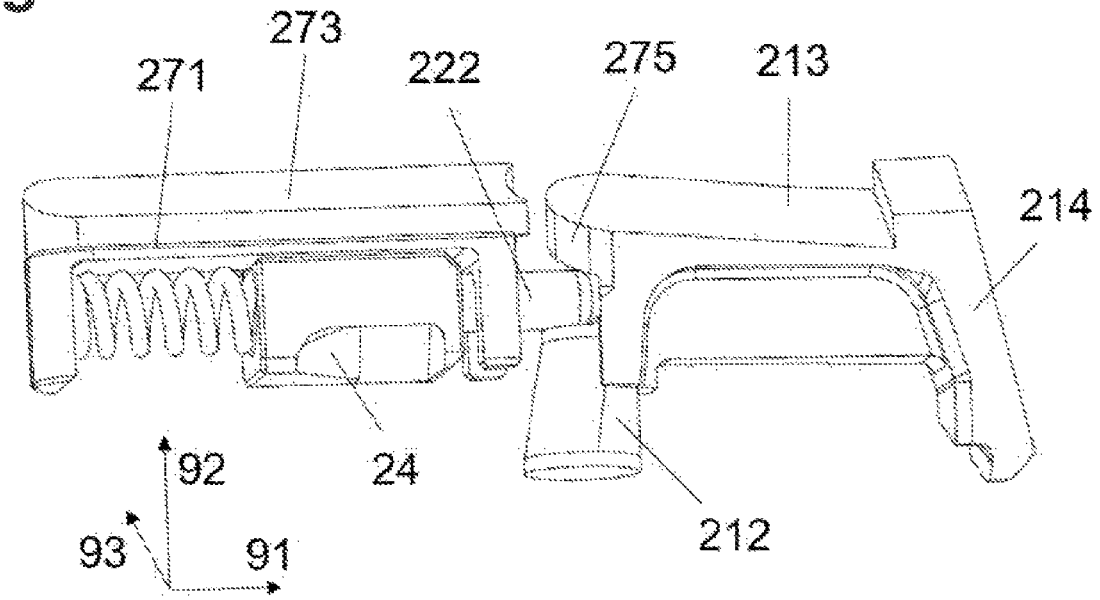
FIGS. 10A and 10B depict an extractor assembly according to the present disclosure in an installation situation (FIG. 10A) and in an operating position (FIG. 10B).
Figure 10B:
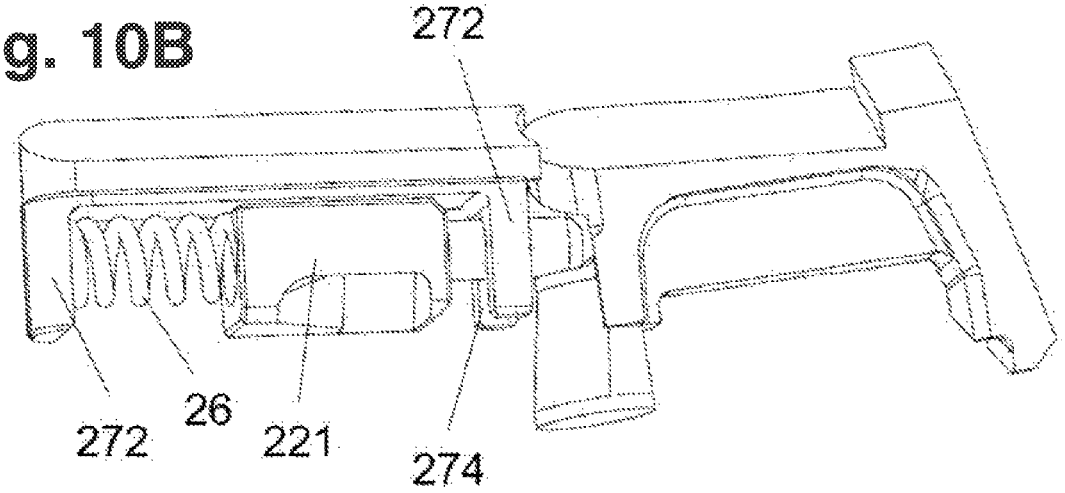

FIG. 9A shows a known extractor 21, a claw-shaped extractor edge being visible in the region of the extractor lever 214. In comparison, a design according to the present disclosure of the extractor is shown schematically in FIG. 9B. It can very clearly be seen that the bearing lever 212 comprises a (support) attachment 275 at the "back," i.e. on the rear side, in the installation situation. This attachment is formed on the side nearer the plunger 22 such that said attachment protrudes slightly above the contact point of the plunger 22 in the installed state. The attachment 275 can prevent an "over-deflection" of the extractor 21 about the tilting axis thereof, as is clear from FIG. 10. FIG. 10A is an isolated illustration of an embodiment of the extractor assembly according to the present disclosure in the installation situation, while FIG. 10B shows the situation in which the extractor 21 is tilted backward about its tilting axis, i.e. the bearing lever 212, when a case (not shown) is ejected. In this operating position, the attachment 275 comes into contact with the frame 27 and supports the extractor in addition to the bearing extension 212. In addition, the attachment 275 can reduce the required movement gap between the extractor 21 and the frame 27 in comparison with the depressor plunger assembly 3 (cf. FIG. 3), as a result of which the plunger extension 222 is also protected against the ingress of foreign bodies from the outside.

Figure 11A:
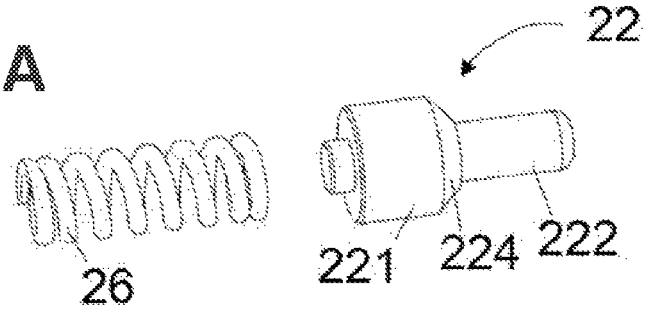
FIGS. 11A-C are schematic depictions of alternative embodiments of plungers according to the present disclosure.

For the above-described advantageous simple disassembly/assembly of the extractor assembly 2 (see description of FIG. 7), it is only necessary for the plunger body 221 to be designed such that it can be deliberately moved backward by external action. By viewing FIG. 11, it quickly becomes clear to a person skilled in the art that different designs of the plunger 22 can lead to this result. FIG. 11A shows a conical plunger body 221, which has the advantage that the rotational position of the plunger is irrelevant for interaction with a tool in the installation situation. Instead of a circumferential chamfer 224, an inclined plane can also be formed on or in the plunger body 221, as shown by way of example in FIGS. 11B and 11C. Such a chamfer 224 should be designed such that it faces the maintenance bore 191 in the installation situation and extends obliquely with respect to an imaginary extension of the plunger extension 222. The schematically shown examples according to the present disclosure can be adapted or modified by a person skilled in the art in accordance with the geometric conditions in the slide 1 and/or the frame 27.

Figure 11B:
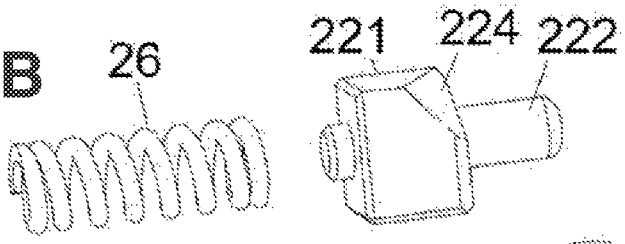
Figure 11C:
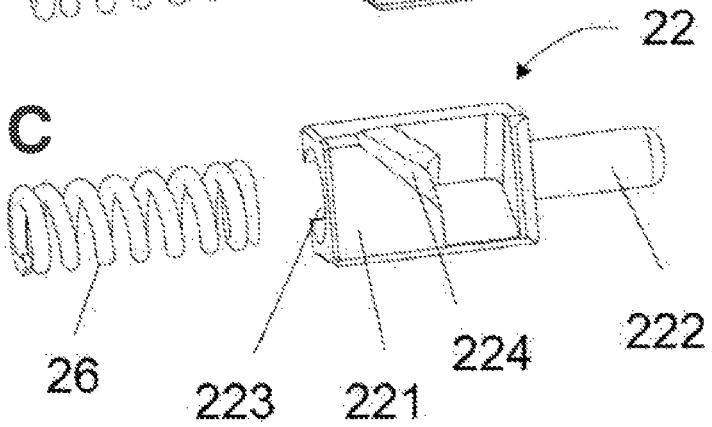

The formation of a rear detent on the plunger body 221 for guiding the biasing element 26 can also be advantageous, as can be seen from FIGS. 11A and 11B. Alternatively, it may be advantageous to prevent the biasing element 26 from slipping by a spring receiving recess 223 being formed on the plunger body 221. As a result, a comparatively heavy or long spring 26 can be used, while still keeping the required overall dimensions of the frame 27 small.

Another aspect of the present disclosure is to make it easier to disassemble the frame 27 when the extractor 21 is already removed. For this purpose, it is advantageous for the receiving groove 19 to extend as far as a first serration 111. As a result, by applying light pressure to the front of the frame 27 in the longitudinal direction of the weapon or the barrel direction 91, said frame can be pushed relatively easily forward out of the receiving groove 19. Such a receiving groove 19 that extends far back is shown in FIG. 2 by way of example.

The invention is not limited to the embodiments shown and described, but can be modified and configured in different ways. In particular the cross-sectional shapes of the above-mentioned strips, rails, recesses etc. can be adapted to the specified basic data; the lengths and positions with respect to the frame can easily be adapted by a person skilled in the art, having knowledge of the present disclosure.

In the description and the claims, as stated above, the terms "front," "back/behind," "above," "below" and so on are used in the generally accepted form and with reference to the object in its usual use position. This means that in a weapon the mouth of the barrel is "at the front," that the breechblock or slide is moved "backward" by the explosive gas, etc. Perpendicular to a direction substantially means a direction rotated by 90° thereto.

It should also be noted that in the description and the claims, terms such as the "lower region" of an object refer to the lower half and in particular the lower quarter of the overall height; "lowermost region" refers to the lowermost quarter and in particular an even smaller part, while "central region" refers to the central third of the overall height. The same applies, mutatis mutandis, to the terms "width" and "length." All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), this means ±10°. When expressions such as "substantially constant" etc. are used, this refers to the technical possibility of deviation and not the mathematical possibility of deviation which is used as a basis by a person skilled in the art. A "substantially L-shaped cross section" therefore has two elongate surfaces, one end of each surface merging into the end of the other surface, and the longitudinal extensions of which are arranged at an angle of from 45° to 120° to one another.

All given quantities and percentages, in particular those relating to the limitation of the invention, insofar as they do not relate to specific examples, are understood to have a tolerance of ±10%, e.g. 11% means 9.9% to 12.1%. With terms such as "a solvent," the word "a" is not to be considered to represent a singular numeral, but rather is to be considered an indefinite article or pronoun, unless the context indicates otherwise.

The terms "combination" and "combinations," unless otherwise stated, mean all types of combinations, starting from two of the relevant components up to a plurality or all of such components; the term "containing" also means "consisting of."

The features and variants stated in the individual embodiments and examples can easily be combined with those of the other examples and embodiments and in particular can be used for characterizing the invention in the claims without necessarily including the other details of the particular embodiment or of the particular example.

List of reference signs:

| | | | |
|---|---|---|---|
| 1 | Slide | 22 | Plunger |
| 11 | Barrel | 221 | Plunger body |
| 111 | Serration(s) | 222 | Plunger extension |
| 12 | Recoil spring assembly | 223 | Spring receiving recess |
| 14 | Firing pin assembly | 224 | Chamfer |
| 15 | Firing pin safety | 26 | Biasing element |
| 16 | Slide cover plate | 27 | Frame |
| 17 | Bearing opening | 271 | Guide(s) |
| 18 | Ejector | 272 | Side element(s) |
| 19 | Receiving groove | 273 | Connection piece |
| 191 | Maintenance bore | 274 | Opening |
| 2 | Extractor assembly | 275 | Attachment |
| 21 | Extractor | 3 | Depressor plunger assembly |
| 212 | Bearing lever | 31 | Depressor plunger |
| 213 | Connection segment | 32 | Depressor plunger spring |
| 214 | Extractor lever | 33 | Spring bearing |
| | | 4 | Tool |
| | | 91 | Barrel direction |
| | | 92 | Normal direction |
| | | 93 | Vertical direction |

The invention claimed is:

1. A firearm, comprising:

a slide;

an ejector; and an extractor assembly including at least one stirrup-shaped extractor, a frame, a plunger, and a biasing element; where the plunger includes a plunger body and a plunger extension; and the plunger body and the biasing element are mounted in the frame;

wherein the slide includes a receiving groove configured to receive the frame, and a maintenance bore in a region of the plunger body, such that when the slide is in an installed state, the maintenance bore penetrates the slide from below in a direction of the receiving groove.

2. The firearm according to claim 1, wherein a shape of the receiving groove is substantially complementary to a shape of the frame of the extractor assembly.

3. The firearm according to claim 1, wherein the frame includes at least one guide configured to be inserted into the receiving groove of the slide.

4. The firearm according to claim 1, wherein the receiving groove (19) has a substantially T-shaped cross section.

5. The firearm according to claim 1, wherein the slide includes at least one lateral serration and the receiving groove extends at least as far as the first lateral serration.

6. The firearm according to claim 1, wherein the frame includes at least one first and one second side element, wherein the first side element is nearer to the plunger than the second side element and includes an opening for a plunger extension and a connection piece that faces outward in an installation situation.

7. The firearm according to claim 6, wherein the opening of the first side element extends continuously inward and/or downward.

8. The firearm according to claim 6, characterized in that the frame is closed between the first side element and the second side element inside the firearm when in an installed state.

9. The firearm according to claim 1, wherein the extractor includes a first bearing lever that is disposed on a rear side of the extractor, adjacent the plunger when the extractor is in an installed state, the first bearing lever further comprising an attachment for supporting the frame when the extractor is in an operating state.

10. The firearm according to claim 1, wherein the plunger body defines a chamfer in a direction of the plunger extension.

11. The firearm according to claim 1, wherein the plunger body defines a spring configured to receive the biasing element.

* * * * *